US007323646B2

(12) United States Patent
Braaten

(10) Patent No.: US 7,323,646 B2
(45) Date of Patent: Jan. 29, 2008

(54) HAND AND FOOT SWITCH

(75) Inventor: Ronald J. Braaten, Woodstock, CT (US)

(73) Assignee: Conntrol International, Inc., Putnam, CT (US)

( * ) Notice: Subject to any disclaimer, the term of this patent is extended or adjusted under 35 U.S.C. 154(b) by 87 days.

(21) Appl. No.: 11/106,208

(22) Filed: Apr. 14, 2005

(65) Prior Publication Data

US 2006/0231374 A1 Oct. 19, 2006

(51) Int. Cl.
*H01H 15/24* (2006.01)
*H01H 3/14* (2006.01)

(52) U.S. Cl. ..... 200/18; 200/52 R; 200/86.5; 200/537; 200/542; 200/574; 200/298

(58) Field of Classification Search ..... 200/17 R, 200/18, 52 R, 42.01, 47, 61.85, 86.5, 537–542, 200/573, 574, 298, 329, 330, 331
See application file for complete search history.

(56) References Cited

U.S. PATENT DOCUMENTS

| | | | | | |
|---|---|---|---|---|---|
| 4,153,990 | A | | 5/1979 | Kamimura | 29/751 |
| 4,293,746 | A | * | 10/1981 | Braaten | 200/86.5 |
| 4,296,291 | A | * | 10/1981 | Johnson | 200/331 |
| 4,568,864 | A | | 2/1986 | Gisske | 318/294 |
| 4,635,903 | A | | 1/1987 | Broyden et al. | 254/362 |
| 4,829,148 | A | * | 5/1989 | Muller | 200/56 R |
| 5,116,333 | A | | 5/1992 | Beane | 606/51 |
| 5,419,518 | A | * | 5/1995 | Fiorenzo | 246/410 |
| 5,817,996 | A | * | 10/1998 | Ulrich et al. | 200/4 |
| 5,836,944 | A | | 11/1998 | Cosmescu | 606/41 |
| 5,889,246 | A | * | 3/1999 | Frank et al. | 200/61.89 |
| 6,064,015 | A | | 5/2000 | Braaten | 200/86.5 |
| 6,104,383 | A | | 8/2000 | Shipman | 345/163 |
| 6,325,795 | B1 | | 12/2001 | Lindemann et al. | 606/32 |
| 6,525,282 | B2 | | 2/2003 | Krebs et al. | 200/298 |
| 6,679,875 | B2 | | 1/2004 | Honda et al. | 606/1 |
| 6,998,557 | B2 | * | 2/2006 | McGuffin-Noll | 200/538 |
| 7,012,203 | B2 | * | 3/2006 | Hanson et al. | 200/86.5 |

OTHER PUBLICATIONS

Internet Citing: Duo-Touch Two-Hand-Control Safety Modules [online]; [retrieved on Jun. 24, 2003]; retrieved from the Internet http://www.bannerengineering.com/products/machine_safety/duotouch/.

Internet Citing: Dimensions and Connection of COB213 [online]; [retrieved on Aug. 6, 2003]; retrieved from the Internet http://www.auspicious.com.tw/pag-f/p02/pg-01.htm (2 pages).

(Continued)

*Primary Examiner*—Michael A Friedhofer
(74) *Attorney, Agent, or Firm*—Cantor Colburn LLP

(57) ABSTRACT

A hand operable switch includes an operating knob that is movable longitudinally or rotationally about a longitudinal axis of the hand operable switch. The operating knob is accessible from any circumferential location of the hand operable switch. A housing includes switching elements wherein movement of the operating knob moves an activation rod relevant to the switching elements for activating a switching element that corresponds to movement of a controlled device. A converter converts the hand operable switch into a foot operable switch.

25 Claims, 9 Drawing Sheets

OTHER PUBLICATIONS

Internet Citing: Insul-8 Pendant Stations [online]; [retrieved on Aug. 6, 2003]; retrieved from the Internet http://www.insul-8.com/Index.cfm/Fuse/Products/App/Pendants.

Internet Citing: 22mm IEC 800E Pendant Stations With or Without DeviceNet [online]; [retrieved on Aug. 6, 2003]; retrieved from the Internet http://www.ab.com/industrialcontrols/products/push_buttons/22mm/pendantstation.html.

Drivecon Corporation Series 80 Pushbutton Switches dated Jul. 20, 1998.

COB213 Series Direct Operation Hoist Push-Button Pendant Switch dated Jun. 23, 1999.

5500 Series Compact Pistol Grip Station 5500/5600 Series Single, Dual & Variable Speed Stations 5700 Series Rubber Enclosure Pendant Stations (8 pages).

* cited by examiner

HAND AND FOOT SWITCH

BACKGROUND OF THE INVENTION

This invention relates to switches for electrically controlling mechanical movement of a physical object, and more particularly relates to an improved and convertible switch assembly.

Hand and foot switches are used in many applications, industrial and commercial as well as residential. Industrial applications may include operation of power tools, conveyers, lifting devices, and many other applications. In many applications, plural foot operated switches are utilized to control more than one operation or function. One common example is the up and down motions of a lifting or vertical positioning device.

Presently used foot switches generally comprise a pivotal actuating treadle to operate a switch arm or a switch actuator in a separate housing. A spring in some form is provided as a treadle return. Generally, the actuating treadle is connected to a rotating shaft for operating a switch. U.S. Pat. No. 6,064,015 to Braaten discloses a foot switch that encloses the operating mechanisms of the foot switch for preventing adverse effects by environmental debris. Such foot switches are not designed for use by hand, nor for hanging in a pendant fashion from a controller.

Presently used hand switches, also known as pendant switches, including a housing for accommodating control elements in the form of switches which are actuated by an operator from outside by buttons. Such hand switches must be rotated within an operator's hand until the buttons are accessible, or the operator must move to a position to access the buttons. In response to the actuation of a button, control signals are generated by which a physical object is moved in a dictated direction. The housing is connected to the physical object, either directly or indirectly, using a cable that includes a separate electric cable by which the control signals are conducted to a control mechanism. Such hand switches are not designed for use by feet, nor for positioning on a floor where one button would be indistinguishable from another without examining the indicia on the buttons or the housing.

BRIEF SUMMARY OF THE INVENTION

The above and other drawbacks and deficiencies are overcome or alleviated by a switch system having a hand-operable switch, the hand-operable switch having a longitudinal axis and including a switching element for providing a control signal to a control box, an activation rod for activating or deactivating the switching element, and an operating portion for moving the activation rod, wherein the operating portion surrounds the activation rod and is hand operable at any circumferential location of the operating portion.

In another embodiment, a converter for converting a hand operable switch, having a hand operable operating portion, into a foot operable switch, includes a bottom plate, a first foot pedal section and a second foot pedal section, wherein the first foot pedal section and the second foot pedal section are depressible towards the bottom plate, a first operating portion engagement device in association with the first foot pedal section and a second operating portion engagement device in association with the second foot pedal section, wherein depressing the first foot pedal section pushes the first operating portion engagement device against the operating portion for activating a first switching element within the hand operable switch and wherein depressing the second foot pedal section pushes the second operating portion engagement device against the operating portion for activating a second switching element within the hand operable switch.

In yet another embodiment, a hand operable switch includes a longitudinal axis, a housing, a first switching element in the housing for sending a control signal to move a controlled device in a first direction, a second switching element in the housing for sending a control signal to move a controlled device in a second direction, opposite the first direction, and an operating portion movable along the longitudinal axis, wherein movement of the operating portion towards the housing activates the first switching element and movement of the operating portion away from the housing activates the second switching element.

The above discussed and other features and advantages of the present invention will be appreciated and understood by those skilled in the art from the following description and drawings.

BRIEF DESCRIPTION OF THE DRAWINGS

Referring to the exemplary drawings wherein like elements are numbered alike in the several FIGS..

DETAILED DESCRIPTION OF THE PREFERRED EMBODIMENTS

A switch system will now be described that incorporates improvements to a hand switch. The switch system can include just the hand switch, or can include optional additional features such as hanging devices, hand guards, or foot converters.

Figure 1:
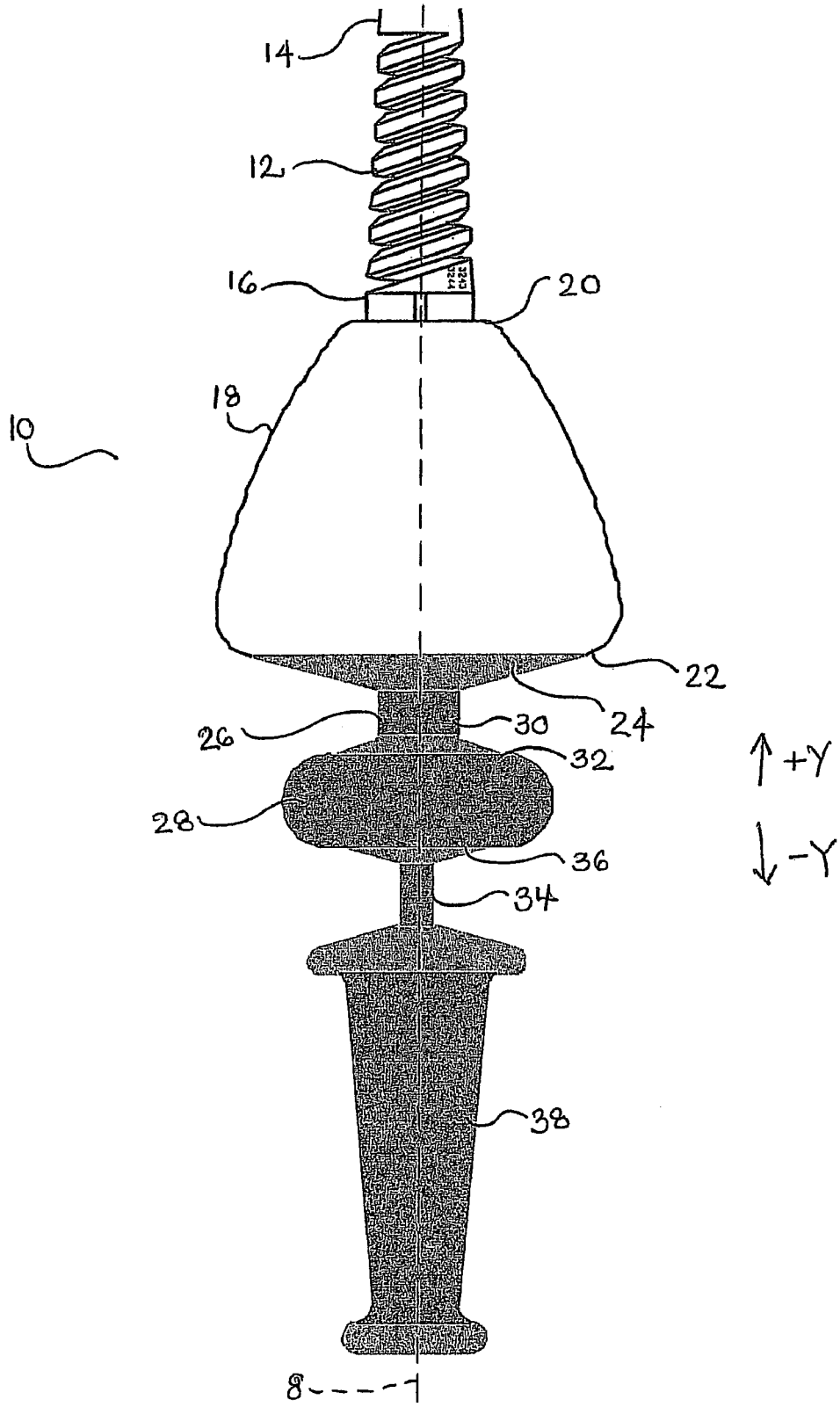
FIG. 1 is side plan view of an exemplary embodiment of a hand switch.

Turning to FIG. 1, an embodiment of a hand switch 10 is shown. The hand switch 10 includes a flexible strain housing 12 for housing and protecting an electrical cable. The flexible strain housing 12 is biased in a position such that a longitudinal axis of the flexible strain housing 12 coincides with a longitudinal axis 8 of the hand switch 10. The flexible strain housing 12 is bendable relative to the longitudinal axis 8 in any direction, and can further be compressed and extended. The flexible strain housing 12 includes a first end 14 and a second end 16. The first end 14 allows for the passage of the electrical cable to be connected to a control box of a device to be controlled. The hand switch 10 can further include a hook for hanging the hand switch 10, or a magnet to place the hand switch on any magnetically attractive material. A length of the flexible strain housing 12 from the first end 14 to the second end 16 may vary depending on application. The second end 16 is connected to a first end 20 of a housing 18. The connection may be via any mechanical engagement, such as, but not limited to, screw threads. In one exemplary embodiment, the second end 16 includes an external male threaded section, while the first end 20 includes an opening having an internal female threaded section for threadably receiving the external male threaded section of the second end 16. While screw thread engagement is specifically described, it should be understood that alternate connections, mechanical or otherwise, are within the scope of the hand switch 10.

The housing 18 can be described as a bell housing due to its bell-shaped cross-section, however alternate shapes are also within the scope of the hand switch 10. The bell housing shape may advantageously shed liquids and dust. The housing 18 includes a second end 22, opposite the first end 20, that is open for receiving a switch mount 24. The switch mount 24 is firmly attached to the housing 18, such as by screws, although other connections are within the scope of the hand switch 10. A seal 25 may be positioned between the switch mount 24 and the housing 18 for sealing the interior formed therein from dust, liquids, debris, etc. The housing 18 and switch mount 24 can form a device having a circular cross-section taken along a plane perpendicularly oriented to the longitudinal axis 8, although other cross-sections are within the scope of the hand switch 10.

Passing through a center of the switch mount 24 is a longitudinally aligned activation rod 26. The activation rod 26 can be pushed into and out of the housing 18 by an operating portion, such as the illustrated operator controlled thumb wheel 28. The longitudinally aligned activation rod 26 includes a first portion 30 positioned on a housing side 32 of the thumb wheel 28, and a second portion 34 positioned on the handle side 36 of the thumb wheel 28. The thumb wheel 28 is movable with the activation rod 26 in the positive and negative Y directions shown, and is also rotatable with the activation rod 26, for reasons which will be further described below.

The hand switch 10 further includes a handle 38, that, as illustrated, includes a generally conical shape following the longitudinal axis 8 of the hand switch 10, however, any handle shape would be within the scope of the hand switch 10. As the activation rod 26 moves further into the housing 18, the activation rod 26 moves further out of the handle 38, and as the activation rod 26 moves further out of the housing 18, the activation rod 26 moves further into the handle 38. Thus, the thumb wheel 28 is movable towards and away from the handle 38 during longitudinal movement of the activation rod 26. It should be understood that an operator's response time to actuate the hand switch 10 is reduced, as compared to a prior pendant having push buttons, because the operator does not have to orient any buttons because the thumb wheel 28 is activatable at any angle.

Figure 2:
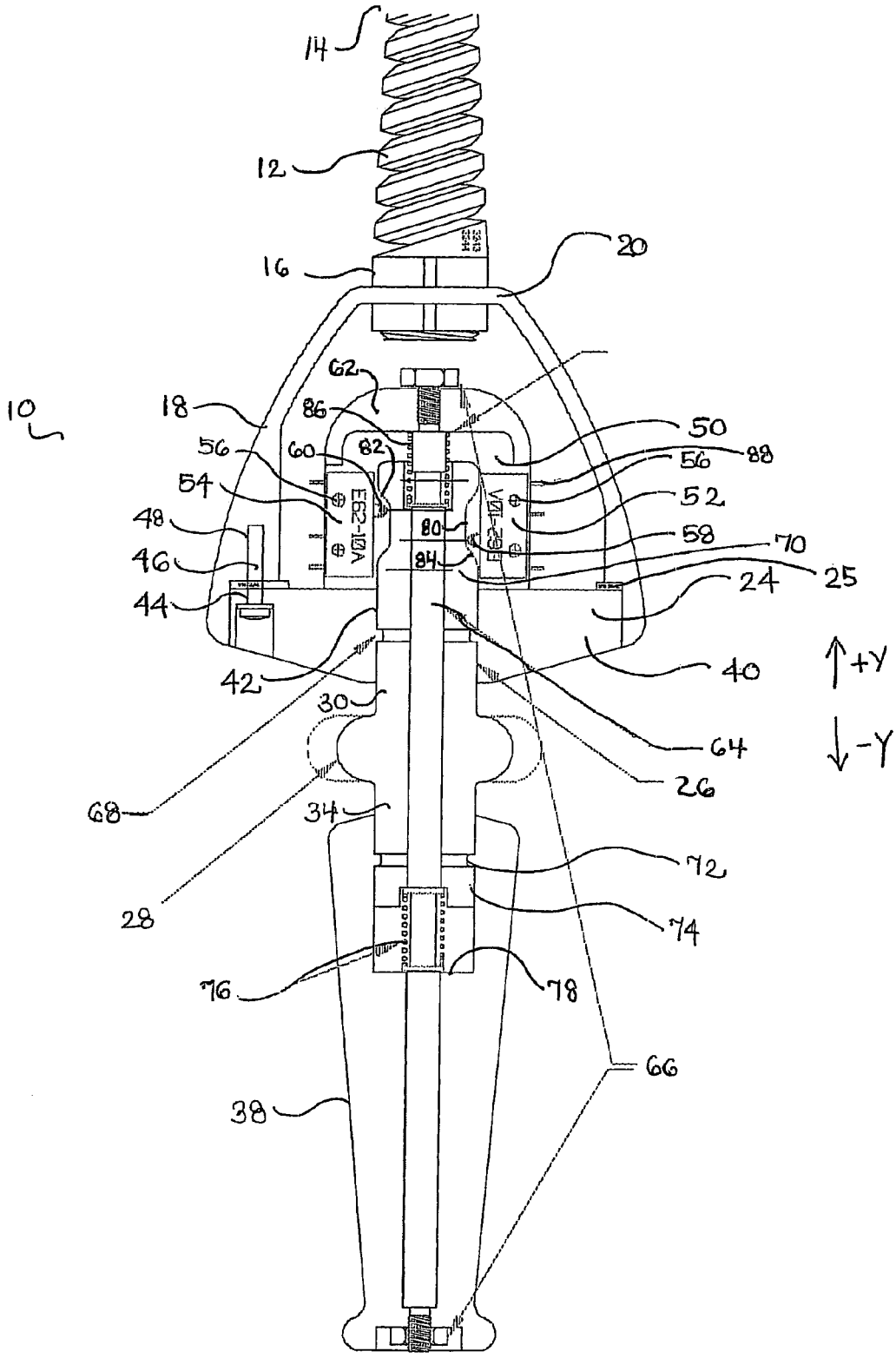
FIG. 2 is a side cross-sectional view of the hand switch of FIG. 1.

Turning now to FIG. 2, an interior view of the housing 18 and handle 38 is revealed. The switch mount 24 includes a base section 40 that substantially closes the open end 22 of the housing 18, except for a rod opening 42 sized for receiving the activation rod 26 and at least one screw hole 44 for receiving a screw for attaching the switch mount 24 to the housing 18. While only one screw hole 44 is shown, the illustrated embodiment includes three equally spaced screw holes 44 for receiving three screws 46 that pass through the screw holes 44 in the switch mount 24 and into corresponding aligned screw holes 48 on the interior of the housing 18. While screws and screw holes are described for attaching the switch mount 24 to the housing 18, it should be understood that alternate arrangements for attaching the switch mount 24 to the housing 18 are within the scope of the hand switch 10.

Extending from the base section 40 of the switch mount 24 is a mounting section 50. The mounting section 50 supports a first switch 52 and a second switch 54. The switches 52, 54 can be secured to the mounting section 50 using screws 56. While two switches are described in the illustrated embodiment, certain applications of the hand switch 10 may require more or less switches. Each switch 52, 54 includes a plunger 58, 60, respectively. As shown in FIG. 2, both switches 52, 54 are in an inactivated state because the plungers 58, 60 are not being engaged and pushed within the body of the switches 52, 54. Thus, FIG. 2 shows a neutral position of the hand switch 10.

Extending from the mounting section 50 of the switch mount 24 is a guide rod connecting section 62 that secures a central guide rod 64 to the switch mount 24. The central guide rod 64 passes longitudinally through the activation rod 26. The central guide rod 64 can be secured to the mounting section 50 and within the handle 38 using nuts 66 as illustrated, or using alternate connection devices. The central guide rod 64 can be made of a single uniform rod, or several solidly connected sections. The central guide rod 64 defines a preset distance between the switch mount 24 and the handle 38.

As further shown in FIG. 2, the thumb wheel 28 and the activation rod 26 are integrally formed, although the thumb wheel 28 may be a separate element that is rigidly attached to the activation rod, such that movement of the thumb wheel 28 correspondingly moves the activation rod 26. The activation rod 26 includes an O-ring indentation 68 between the first portion 30 and a cam portion 70. An O-ring positioned in the O-ring indentation 68 seals off the rod opening 42 as the activation rod 26 passes in and out of the switch mount 24. The illustrated embodiment of the hand switch 10 further includes an additional O-ring indentation 72 between the second portion 34 and a handle portion 74 of the activation rod 26, for receiving an additional O-ring for protecting the handle interior from debris. In particular, a spring 76, such as a compression spring, that is positioned within the handle 38 and surrounding the guide rod 64 is protected from such debris. The spring 76 is positioned between the handle portion 74 of the activation rod 26 and an inner ledge 78 within the handle 38. With O-rings in place, the hand switch may be substantially waterproof.

The cam portion 70 of the activation rod 26 is responsible for activating the switches 52, 54. The cam portion 70 includes a generally hour-glass shape as shown. The cam portion 70 includes a central concave section 80 positioned between a first plunger engaging cam 82 and a second plunger engaging cam 84. The cam portion 70 of the activation rod 26 has an external diameter at the central concave section 80 that is less than an external diameter at the first plunger engaging cam 82 and the second plunger engaging cam 84. It should be noted that the plunger 58 is located closer to the base section 40 of the switch mount 24 than the plunger 60. In the neutral position shown in FIG. 2, the plungers 58, 60 are both located within the central concave section 80, but the plunger 58 is positioned adjacent the second plunger engaging cam 84 and the plunger 60 is positioned adjacent the first plunger engaging cam 82. A spring 86, such as a compression spring, is positioned about the guide rod 64 between the guide rod mounting portion 62 and an interior of the cam portion 70.

The operation of the hand switch 10 occurs as follows. With the hand switch 10 biased (via the springs 76, 86) in the neutral position as shown in FIG. 2, an operator may decide to move a controlled device associated with the hand switch 10 in a particular direction, or in a particular condition. By example only, the hand switch 10 can be hung in the vertical direction shown such that movement of the thumb wheel 28 in the negative y direction will move a lift table, for example, downwardly, while moving the thumb wheel 28 in the positive y direction will move the lift table upwardly. In such an exemplary embodiment, movement of the lift table, or other controlled device, is intuitively controlled by the operator moving the thumb wheel 28 in the same direction as the desired movement of the lift table.

With the thumb wheel 28 positioned in the neutral position shown in FIG. 2, the cam portion 70 of the activation rod 26 is positioned such that the plungers 58, 60 are both located within the central concave section 80, and are thus not pushed into the switch 52, 54, and are thus not activating the switches 52, 54. When the thumb wheel 28 is pushed in the positive Y direction, the second plunger engaging cam 84 engages the plunger 58 of the switch 52. Because the plunger 60 is positioned further from the base section 40 of the switch mount 24, the second plunger engaging cam 84 does not engage the plunger 60. Instead, the plunger 60 is still located within the central concave section 80. Thus, when the thumb wheel 28 is pushed in the positive Y direction, only switch 52 is activated. In an exemplary embodiment, activation of switch 52 can send a signal to a control box of the controlled device to move a lift table, by example only, upwardly. Of course, other control signals that result from an activation of the switch 52 are within the scope of the hand switch 10.

In order to engage switch 54, the thumb wheel 28 is moved in the negative Y direction. Movement of the thumb wheel 28 in the negative Y direction causes the cam portion 70 to correspondingly move in the negative Y direction such that the first plunger engaging cam 82 engages with the plunger 60, however the plunger 58 remains in the central concave section 80 thus the switch 52 remains inactivated. In an exemplary embodiment, activation of switch 54 can send a signal to a control box of the controlled device to move a lift table, by example only, downwardly. Of course, other control signals that result from an activation of the switch 54 are within the scope of the hand switch 10.

It should be understood that electrical connectors 88 extending from the switches 52, 54 are electrically connected to the electrical cable housed and protected by the flexible strain housing 12. Thus, electric signals emanating from either of the switches 52, 54 are sent through the electrical cable to the control box associated with the controlled device. The electrical connection between the switches 52, 54 and the electrical cable may be via a card, such as a printed circuit board, housed within the housing 18, or simply through electrical wiring.

Figure 3:
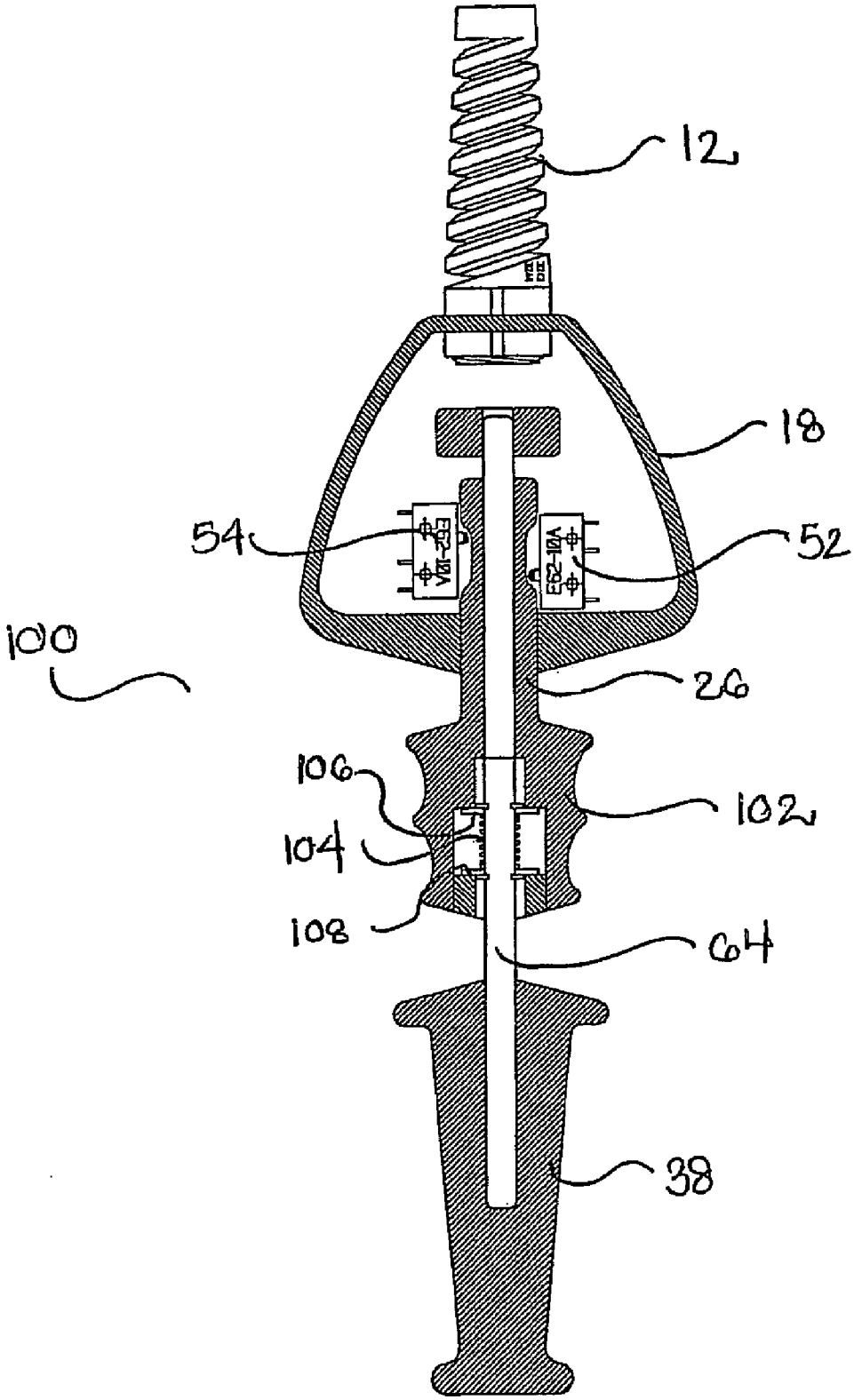
FIG. 3 is a side cross-sectional view of another exemplary embodiment of a hand switch.

FIG. 3 demonstrates other exemplary embodiments of the hand switch. The hand switch 100, while functionally similar to the hand switch 10, includes an operating portion, such as a double concave operating portion 102, for moving the activation rod 26 in the positive and negative Y directions. The ergonomic shape of the operating portion 102 provides easily accessible areas at any angle for movement of the activation rod 26. The operating portion 102 may further house a single compression spring 104, biased in the position shown in FIG. 2. The operating portion 102 may include first and second ledges 106, 108 such that as the operating portion is pushed in the positive Y direction to activate switch 52, the operating portion 102 is biased back to the neutral position when the operator releases the operating portion 102. Likewise, when the operating portion 102 is pushed in the negative Y direction to activate switch 54, the operating portion 102 is biased back to the neutral position when the operator releases the operating portion 102. It is further noted that since there is no compression spring within the handle 38, the activation rod 26 does not extend into the handle 38 as in the prior embodiment.

Figure 4:
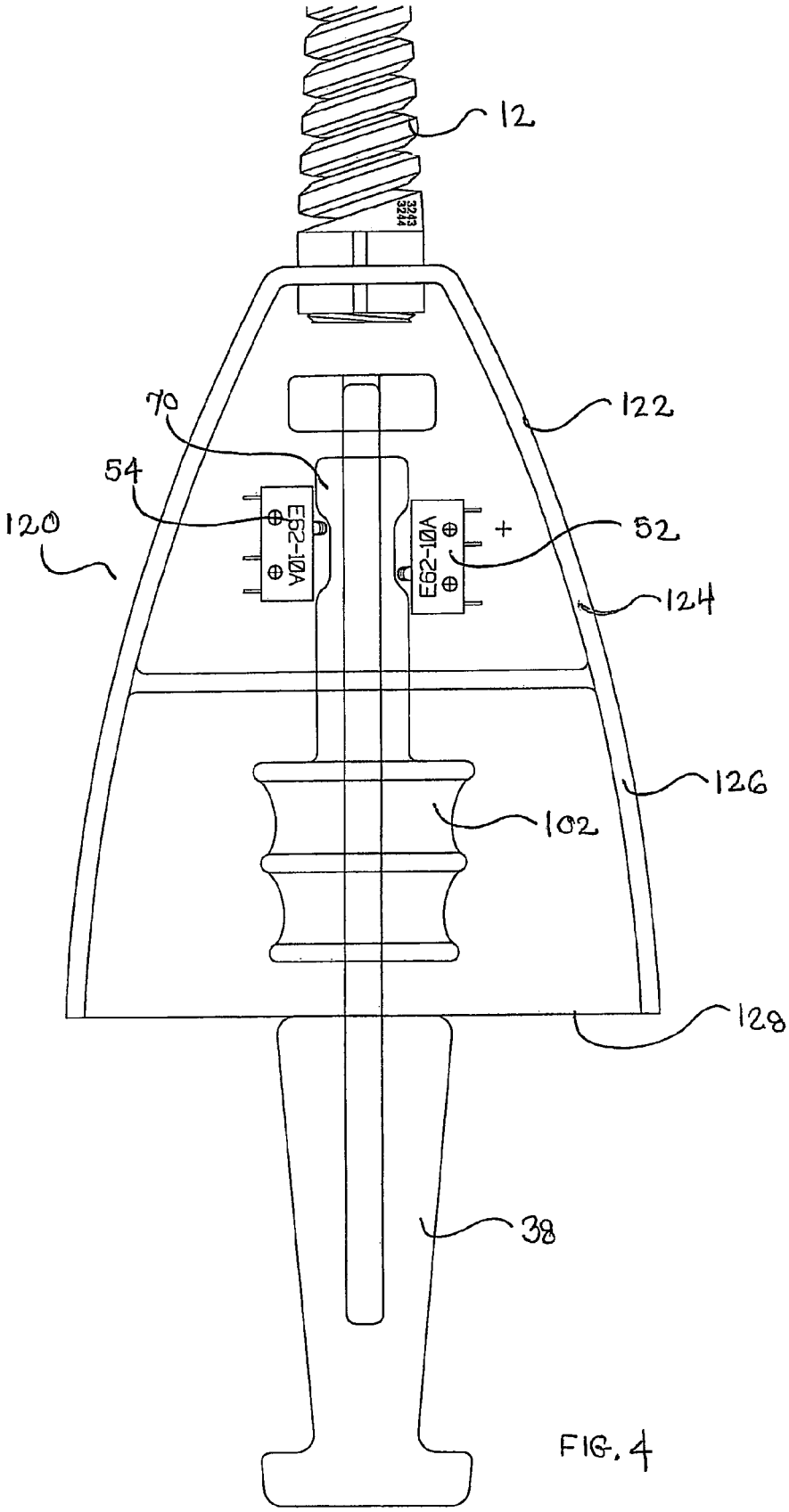
FIG. 4 is a side cross-sectional view of another exemplary embodiment of a hand switch.

FIG. 4 demonstrates other exemplary embodiments of the hand switch. The hand switch 120 again functions similarly as the hand switches 10 and 100, but includes a housing 122 instead of the housing 18. The housing 122 includes a switch housing portion 124 for housing the switching elements as does the housing 18. The housing 122, however, additionally includes an umbrella portion 126 that circumferentially surrounds the operating portion 102 and provides ample space for receiving at least the operator's thumb. The umbrella portion 126 is open at end 128 for accessing the operating portion 102. This embodiment provides additional protection to the switching interior from debris and other environmental factors via the umbrella portion 126. While the umbrella portion 126 is described as part of a housing 122, it is within the scope of this hand switch to provide the umbrella portion 126 as an option to the hand switch. In such a case, means for mechanically engaging the umbrella portion 126 to the housing 122 would be required, such as screws, correspondingly engaged screw threads, snap fit connections, etc.

Figure 5:
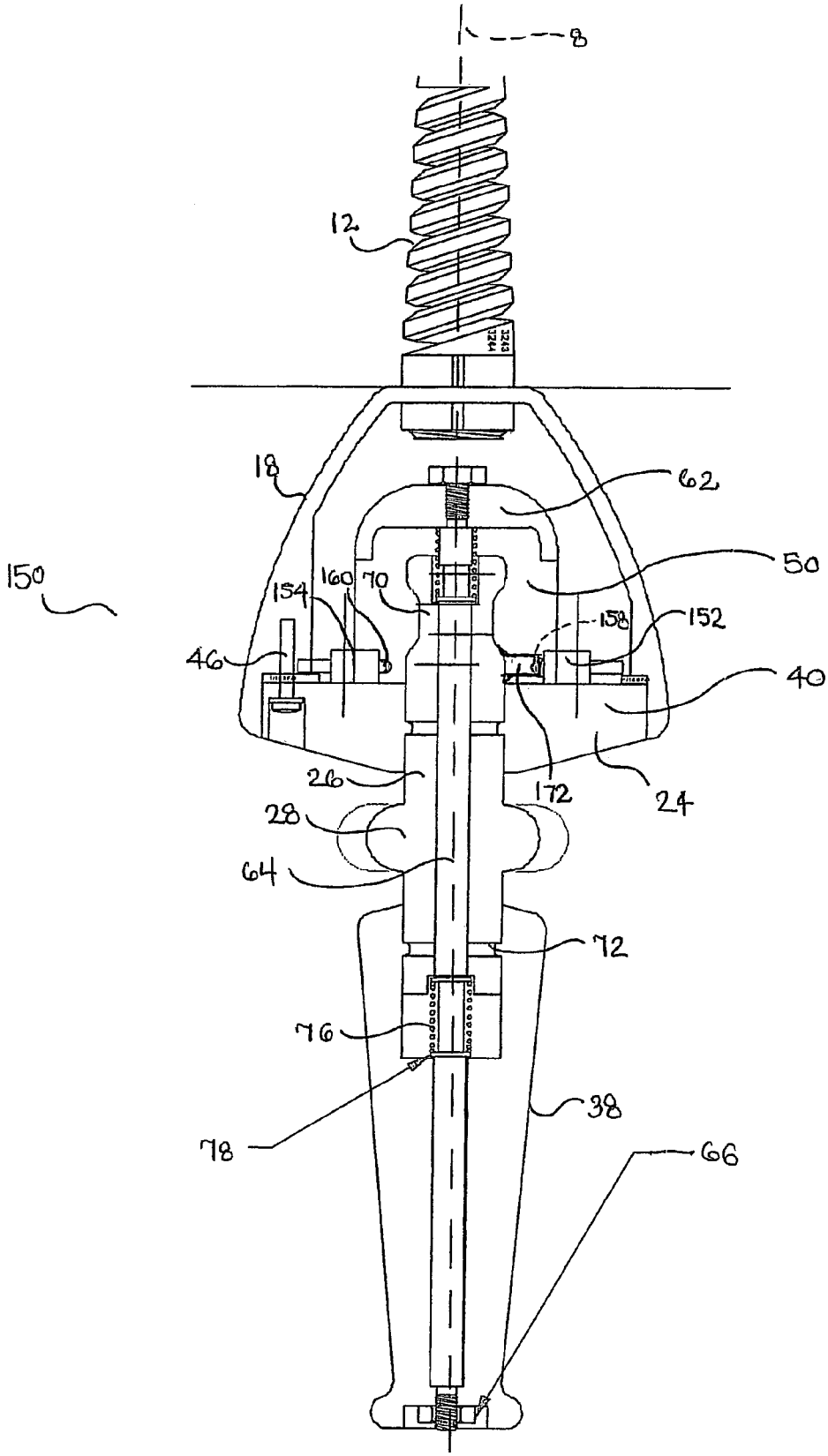
FIG. 5 is a side cross-sectional view of another exemplary embodiment of a hand switch.

Turning now to FIG. 5, other exemplary embodiments of the hand switch are shown. The illustrated hand switch 150 includes switches 152, 154 mounted on base section 40 of the switch mount 24, although they could alternatively be mounted on the mounting section 50. Activation of the switches 152, 154 is via the depression of plungers 158, 160 on the switches 152, 154, respectively. The cam portion 70 of the activation rod 26 includes at least one plunger engaging paddle 172 that engages either plunger 158 (as shown) or plunger 160 depending on the rotational movement of the thumb wheel 28. The cam portion 70 could alternatively include a pair of plunger engaging paddles 172 such that one plunger engaging paddle engages plunger 158 during one of a clockwise or counter clockwise rotation of the thumb wheel 28, and another plunger engaging paddle engages plunger 160 during the other of a clockwise or counter clockwise rotation of the thumb wheel 28. The hand switch 150 can be biased such that neither plunger 158, 160 is engaged (a null/neutral position), and can further include a torsion spring (not shown), or other spring, to bias the hand switch 150 to such a condition. The hand switch 150 can further include stops, such as protrusions extending from the base section 40 of the switch mount 24, for preventing over travel of the thumb wheel 28. It is noted that in the hand switch 150, if the switches 52, 54 are not employed, then certain elements can be eliminated from the hand switch 150, such as compression springs 76, 86 and concave portion 80. Alternatively, such elements can be left in place for future modification of the hand switch 150 to include switches 52, 54. The thumbwheel 28 for operating switches 152, 154 may be provided with depressions or indentations to aid in the rotation of the thumb wheel 28. The switches 152, 154 may be employed for delivering any control signal, such as, by example only, movement of a controlled device in opposite horizontal directions. The hand switch 150 can be hung in relation to the controlled device such that rotation of the thumb wheel 28 in opposite directions intuitively controls movement of the controlled device in opposite directions.

Figure 6:
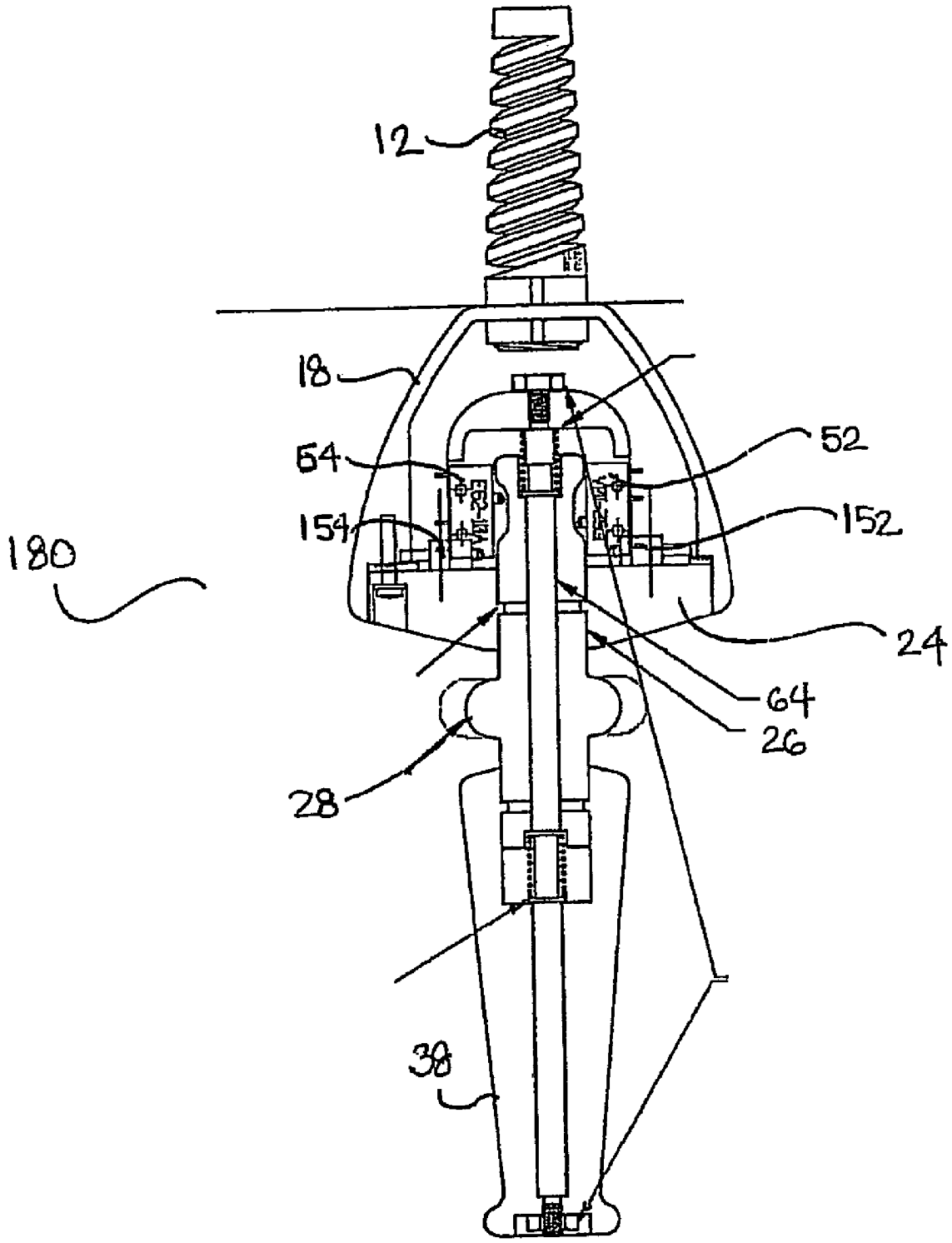
FIG. 6 is a side cross-sectional view of another exemplary embodiment of a hand switch.

FIG. 6 demonstrates an exemplary embodiment of a hand switch 180 that includes switches 52, 54, that are operated via movement of the thumb wheel 28 in positive and negative Y directions, and switches 152, 154, that are operated via movement of the thumb wheel 28 in clockwise and counter clockwise directions. While any control signals could be attributed to the switches, the hand switch 180 could be advantageously arranged relative to a controlled device such that movement of thumb wheel 28 in a positive Y direction would move the controlled device in a positive Y direction, movement of thumb wheel 28 in a negative Y direction would move the controlled device in a negative Y direction, movement of thumb wheel 28 in one rotational direction would move the controlled device in one direction perpendicular to the Y directions, and movement of thumb wheel 28 in an opposite rotational direction would move the controlled device in an opposite direction perpendicular to the Y directions. Thus, an operator can use the hand switch 180 to control a controlled device using movements in directions similar to those experienced by the controlled device.

Figure 7:
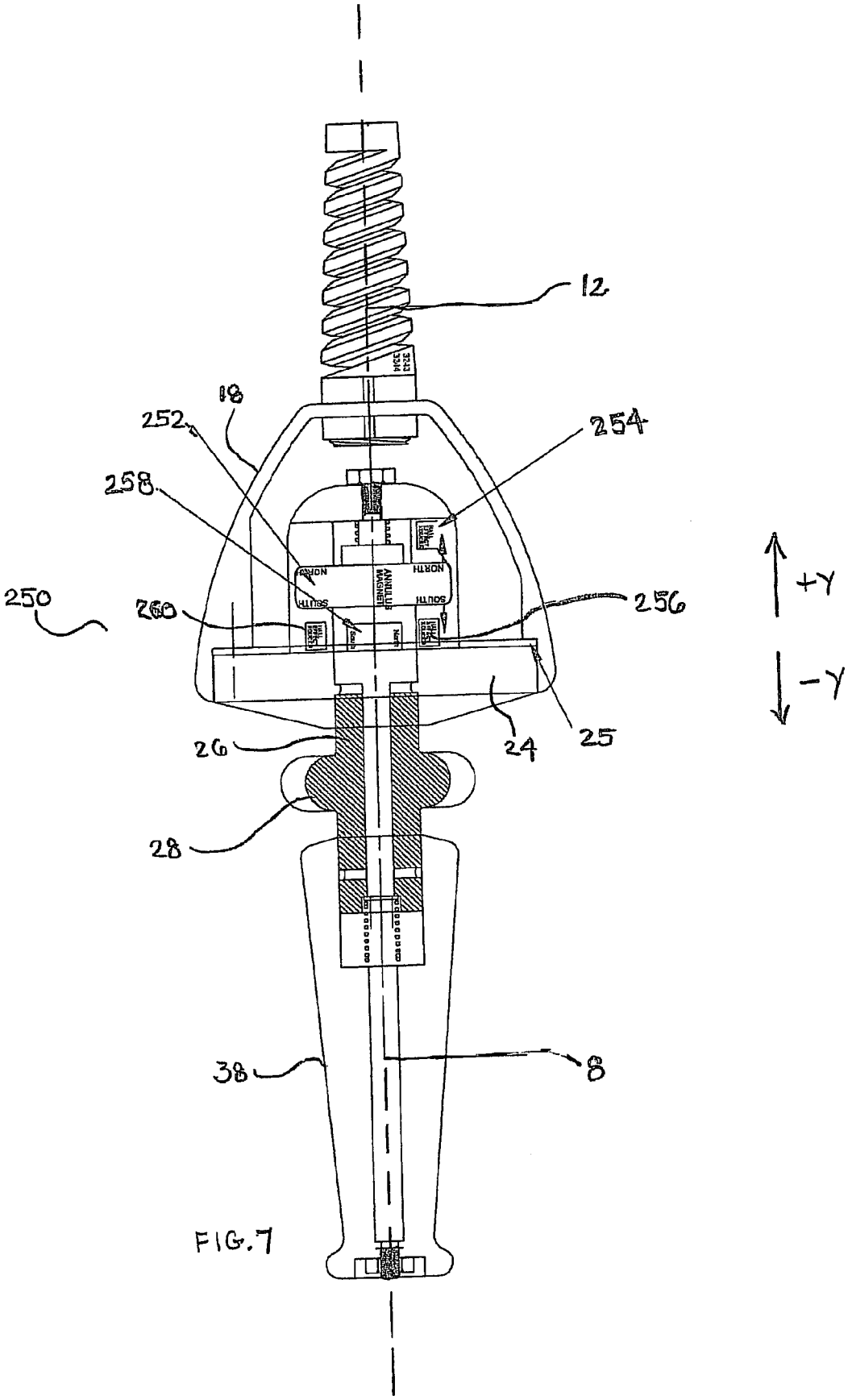
FIG. 7 is a side cross-sectional view of another exemplary embodiment of a hand switch.

As a further option, the hand switches previously described can be provided with a Hall effect sensor that sends a Hall effect electric signal to the control box via the electrical cable. When a magnetic field is applied perpendicularly to a Hall element in the Hall effect sensor, a voltage is created on opposite edges of the Hall element. The ratio of the voltage created to the amount of current flowing through the Hall element is known as the Hall resistance. The Hall effect sensor can output a voltage that is proportional to the applied magnetic field. As shown in FIG. 7, a hand switch 250 is shown to embody the Hall effect sensor option. It should be understood that other features provided in the hand switches of FIGS. 1-7, although not particularly detailed within FIG. 7, may also be included in the hand switch 250, but are not shown for clarity. A magnet 252 positioned on the activation rod 26, and within the interior of the housing 18 and switch mount 24, can move relative to the Hall effect sensor, (Hall effect transducers 254, 256), thus altering the magnetic field applied to the Hall effect sensor and changing the Hall effect electric signal passed to the control box. Each Hall effect transducer 254, 256 occupies a discrete location with respect to the longitudinal axis 8. The magnet 252 may be a ring shaped, annulus magnet positioned on the activation rod 26 and movable with the activation rod 26 to position the magnet 252 closer towards either the Hall effect transducer 254 or the Hall effect transducer 256. The Hall effect electric signal delivered to the control box can be related to the speed in which the controlled device is moved. For example, if the thumb wheel 28 is moved quickly either towards or away from the housing 18, the controlled device will likewise be moved quickly in the dictated direction, and if the thumb wheel 28 is moved slowly either towards or away from the housing 18, the controlled device will likewise move slowly in the dictated direction. The magnet 252 is movable in the positive and negative Y directions towards and away from the Hall effect transducers 254, 256 as shown, with a null position positioned centrally between the Hall effect transducers 254, 256. The magnet 252 is magnetized such that one pole (e.g., the North pole, as illustrated) faces the Hall effect transducer 254 and the other pole (e.g., the South pole, as illustrated) faces the Hall effect transducer 256. The Hall effect transducers 254, 256 and the magnet 252 can be used alone for signaling direction of movement to the control box (as do the switches 52, 54) or can be used for both signaling direction of movement and indicating speed of movement. Alternatively, the Hall effect transducers 254, 256 and the magnet 252 can be used in conjunction with the previously described switches 52, 54. That is, the switches 52, 54 could be used for indicating direction of movement, while the Hall effect sensor system could be used for indicating speed of movement.

For detecting rotation of the thumb wheel 28, a cylindrical magnet 258 can be placed within or about the activation rod 26 as shown, for rotational movement with the activation rod 26. A Hall effect transducer 260 may be placed along the same longitudinal location as the magnet 258. Although the magnet 258 is shown with the South pole facing the Hall effect transducer 260, it should be understood that a neutral, or null, position of the magnet 258 would position the South pole and North pole equidistantly from the Hall effect transducer 260. The activation rod 26 may be biased in the null/neutral position by a torsion spring (not shown), or other suitable spring or biasing means. The Hall effect transducer 260 and the magnet 258 can be used alone for signaling direction of movement to the control box (as do the switches 152, 154) or can be used for both signaling direction of movement and indicating speed of movement. Alternatively, the Hall effect transducer 260 and the magnet 258 can be used in conjunction with the previously described switches 152, 154. That is, the switches 152, 154 could be used for indicating direction of movement, while the Hall effect sensor system could be used for indicating speed of movement.

While Hall effect transducers are specifically described with respect to the embodiment of a hand switch 250, it should be understood that alternate sensing elements would be within the scope of the hand switch, such as, but not limited to, potentiometers, light sensing elements, etc. Likewise, the magnets 252, 258 used in the Hall effect sensing systems may be replaced by elements that are particularly detectable by the chosen alternate sensors.

Figure 8:
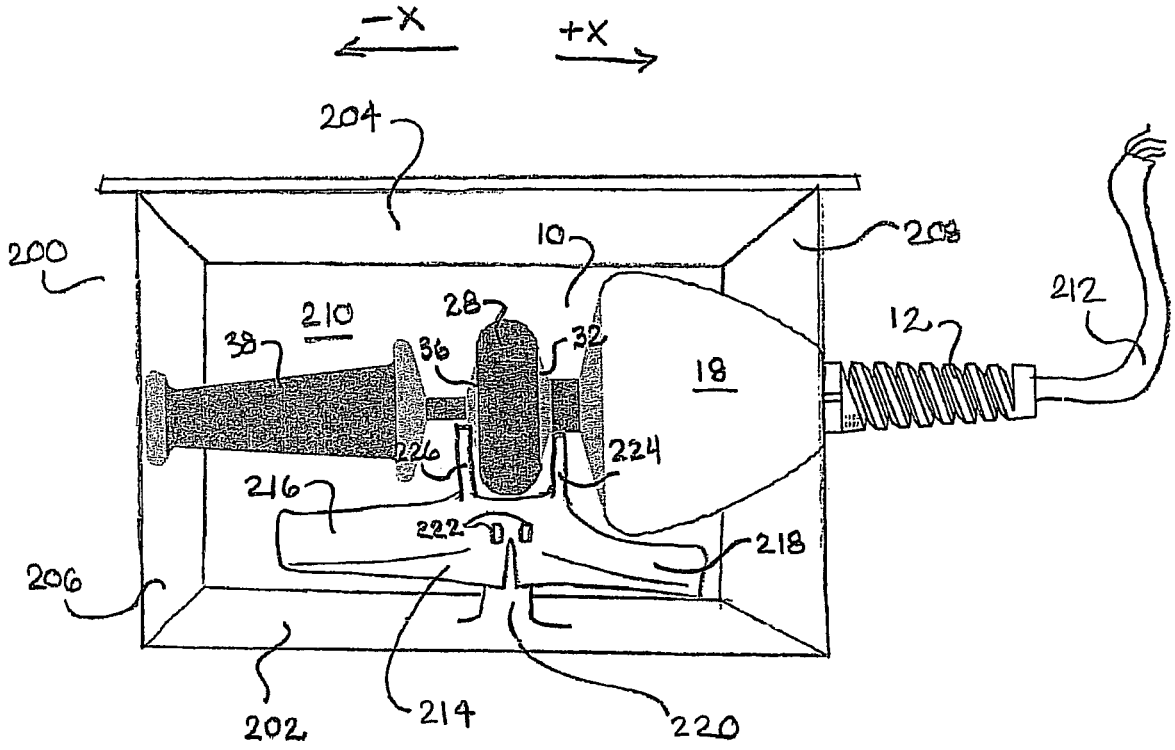
FIG. 8 is a front plan view of an exemplary foot converter for use with a hand switch as shown in one of FIGS. 1-7.

While the hand switches described in relation to FIGS. 1-7 are ideally suited for hand use, the switch system described herein may further include a foot converter that can convert the hand switch described in FIGS. 1-7 to a foot switch. Turning now to FIG. 8, an exemplary embodiment of a switch system including the foot converter 200 is shown. While hand switch 10 is shown within the foot converter 200, it should be understood that any of the hand switches described herein could be utilized within the foot converter 200. The foot converter 200 is shown including a bottom floor 202, a top wall 204, a pair of opposing side walls 206, 208, and a back wall 210. At least one of the walls, such as top wall 204 and/or back wall 210, is removable for insertion of the hand switch therein. By example only, a slot can be provided in side wall 208 such that when top wall 204 is removed, the hand switch is insertable into the confines of the hand converter 200 by sliding the end 20 of the housing 18 into the slot. The top wall 204 can then be replaced to form the 5 walled box with open front. The handle 38 can be screwed or otherwise secured to the side wall 206, and the electrical cable 212 that passes through flexible strain housing 12 passes exteriorly of the foot converter 200.

The foot converter 200 includes a pivotal foot pedal 214 that includes a first pedal section 216 and a second pedal section 218. The foot pedal 214 is supported by at least one supporting beam 220. The illustrated front supporting beam 220 includes a pair of prongs 222 that pass through correspondingly shaped openings in the foot pedal 214. A rear supporting beam 220 (hidden from view) located closer to the back wall 210 includes an aperture for receiving a prong extending from a rear of the foot pedal 214. Thus, the foot pedal 214 is pivotally supported on the supporting beams 220 about an axis defined by a line connecting the front and rear supporting beams 220. The foot pedal 214 further includes a pair of pusher flanges 224, 226 that protrude away from the bottom floor 202 and towards the hand switch 10. Pusher flange 224 is positioned adjacent side 32 of thumb wheel 28 and pusher flange 226 is positioned adjacent side 36 of thumb wheel 28. The pusher flanges 224, 226 may be provided with semi-circular, or curved top surfaces for partially surrounding the activation rod 26.

During use, an operator can choose to depress either the first pedal section 216 or the second pedal section 218 with a foot. When the second pedal section 218 is depressed, that is, pushed towards the bottom floor 202, the second pusher flange 226 pushes the thumb wheel 28 in the positive X direction. As previously described with respect to FIG. 2, when the thumb wheel 28 is pushed towards the housing 18, switch 52 is activated. When the first pedal section 216 is depressed, that is, pushed towards the bottom floor 202, the first pusher flange 224 pushes the thumb wheel 28 in the negative X direction. As previously described with respect to FIG. 2, when the thumb wheel 28 is pushed towards the handle 38, switch 54 is activated. It should further be noted that the foot converter 200 does not require the use of springs as the biased condition of the thumb wheel 28 maintains the foot pedal 214 in its biased condition. Indicia may be provided on the foot converter 200 to remind an operator of the directions in which a controlled device will move when the first or second pedal sections 216, 218 are depressed. Such indicia may be provided on an exteriorly visible surface of the top wall 204. Thus, a foot converter 200 has been described that can convert a hand operable switch into a foot operable switch.

Figure 9:
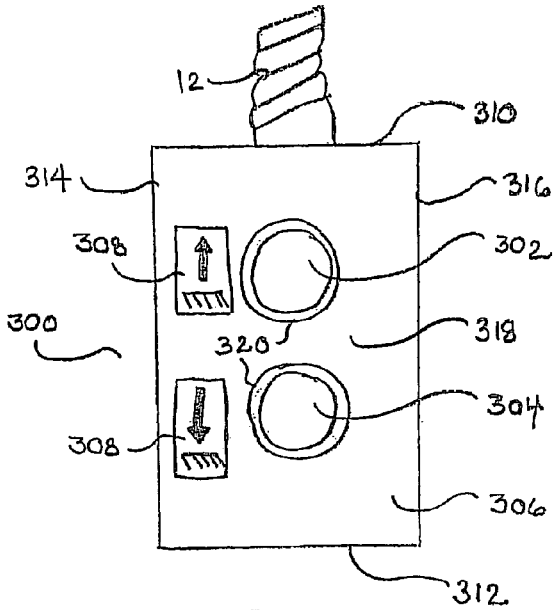
FIG. 9 PRIOR ART
FIG. 9 is a front plan view of an exemplary hand switch of the prior art; and, FIG. 10 is a front plan view of an exemplary foot converter for use with the hand switch of FIG. 9.

The foot converter concept may also be applied to alternate hand operable switches, such as the prior art hand switch 300 shown in FIG. 9. The hand switch 300 can be any known hand switch, and, as in the illustrated embodiment, can include a first depressible button 302 and a second depressible button 304 that may alternatingly be pressed into the switch housing 306 for sending signals to a control box for controlling a controlled device. The switch housing 306 can include indicia 308 for instructing an operator on which button 302, 304 to press to achieve a desired effect. The switch housing 306 further includes a first end 310 from which a strain relief housing 12 may extend, or alternately just the electrical cord 212. A second end 312 is opposite the first end 310, and opposing third and fourth sides 314 and 316 may connect the first end 310 to the second end 312. A button surface 318 may include openings 320 for allowing the buttons 302, 304 to pass through. The hand switch 300 can also include a back surface (not shown) opposite the button surface 318 and for completing the switch housing 306.

Figure 10:
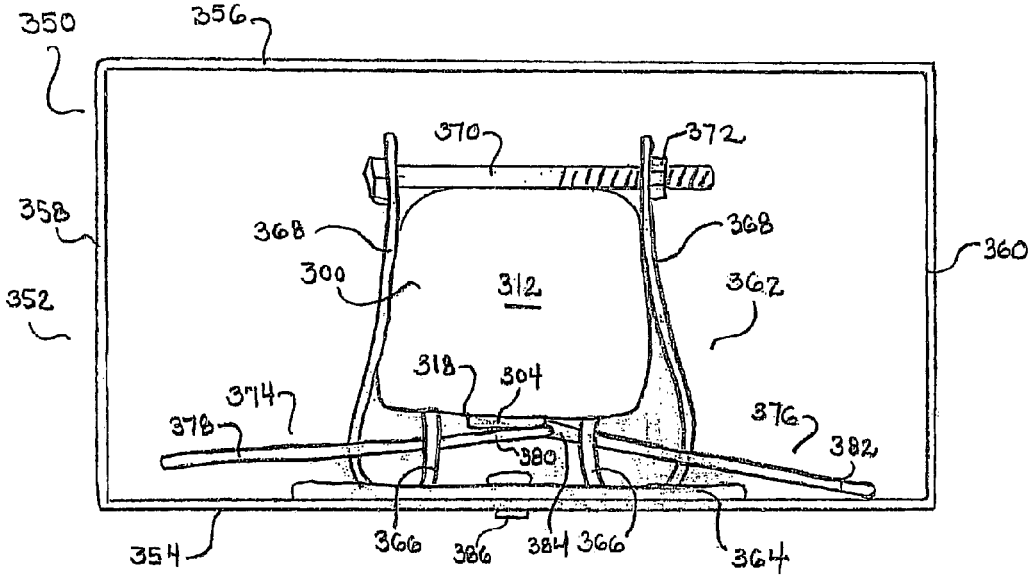

Turning now to FIG. 10, a foot converter 350 is shown. The foot converter 350 is sized to accept an exemplary hand switch 300 for allowing an operator to easily control the hand switch 300 using a foot. The foot converter 350 includes a housing 352 having a first, bottom wall 354, an opposing second, top wall 356, a third, side wall 358, and an opposing fourth, side wall 360. Secured to the first wall 354 is a hand switch holder 362 that includes a bottom plate 364 and a pair of upwardly projecting supports 366 that support the hand switch 300 between a pair of upwardly projecting clamping walls 368. The hand switch 300 is positioned between the pair of upwardly projecting clamping walls 368 such that the button surface 318 faces the bottom plate 364 and the first, bottom wall 354. The hand switch 300 is held therein by passing a screw 370 through the clamping walls 368 and securing it with a nut 372 as illustrated, although other securing devices may be utilized and are within the scope of this foot converter. That is, while clamping walls 368 and supports 366 are illustrated for holding the hand switch 312 in place, alternate designs of hand switch supports that support the hand switch 300 relative to foot pedals 374, 376 would be within the scope of this converter 350. By example only, the hand switch support may include a formed housing that holds the hand switch 300 relative to the foot pedals 374, 376.

Pivotal with respect to the clamping walls 368 and the supports 366 are a pair of foot pedals 374 and 376. The foot pedals 374, 376 include slots (not shown) for allowing the passage of the clamping walls 368 therethrough and the supports 366 include slots (not shown) for allowing the passage of the foot pedals 374, 376 therethrough. The foot pedal 374 includes a foot pressing section 378 and a button pressing section 380. Due to gravity, the button pressing section 380 may rest gently on the button 304, but does not depress it unless the foot pressing section 378 is stepped on and thus pushed down towards the first wall 354. When the foot pressing section 378 is pushed towards the first wall 354, the button pressing section 380 is pivoted upwardly towards the second wall 356 and depresses the button 304. The foot pedal 374 is shown in a non-depressed condition, and thus the foot pressing section 378 is spaced from the first wall 354. The foot pedal 376 is shown in an activated condition, with a foot pressing section 382 pushed downwardly (as by a foot) towards the first wall 354, thus pivoting a button pressing section 384 (mostly hidden from view) towards the button 302 (also hidden from view). It should be understood that the button pressing section 380 of the foot pedal 374 only extends adjacent to the button 304 while the button pressing section 384 of the foot pedal 376 only extends adjacent to the button 302.

Indicia can be provided on the second wall 356 for clearly indicating to an operator which foot pedal 374, 376 should be depressed for achieving a desired effect of a controlled device. Indicia can also be provided on any of the other walls 354, 358, 360, and on the foot pedals 374, 376. Also, it should be noted that the walls 356, 358, 360, and even the wall 354 are not necessary for the proper function of the foot converter 350, although their inclusion within the foot converter 350 helps prevent the accidental operation of the switch 300 by a person walking by. The wall 354 helps stabilize the switch 300 within a particular location via securement device 386. Alternatively, the plate 364 could be secured or placed relative to a piece of equipment having the controlled device without the need for the wall 354.

It should further be noted that the foot converter 350 does not require the use of springs as the biased condition of the buttons 302, 304 maintains the foot pedals 374, 376 in their biased condition. Thus, a foot converter 350 has been described which can convert a standard hand operable switch into a foot operable switch. It is further noted that the converter 200 and converter 350, shown in FIGS. 8 and 10 respectively, illustrate two embodiments of converting a hand operable switch into a foot operable switch. Alternate designs not specifically detailed herein would also be within the scope of such converters. For example, changes in a hand switch design may require changes in a converter in order to accommodate the new hand switch. It should further be noted that the converter does not require a disassembly of the hand switch used therein, instead, the hand switch may be easily placed therein and removed therefrom such that the hand switch may be used as either a standard hand switch or as a foot switch. Thus, the converter disclosed herein provides options to an operator not previously available.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. A switch system comprising a hand-operable switch, the hand-operable switch having a longitudinal axis and including:

a switching element for providing a control signal to a control box;

an activation rod for activating or deactivating the switching element;

an operating portion for moving the activation rod, wherein the operating portion surrounds the activation rod and is hand operable at any circumferential location of the operating portion;

a handle portion extending from said operating portion, wherein said operating portion is disposed between said handle portion and said switching element, and wherein said handle portion is configured to be grasped or held by a hand of a user.

2. The switch system of claim 1, wherein the activation rod includes a cam portion for engaging a plunger of the switching element when the operating portion is pushed in a first longitudinal direction.

3. The switch system of claim 2 wherein the hand operable switch further comprises a first switching element having a first plunger and a second switching element having a second plunger, wherein the second plunger is longitudinally offset from the first plunger, the cam portion including a first plunger engaging cam and a second plunger engaging cam, wherein movement of the operating portion in a first longitudinal direction moves the first plunger engaging cam over the first plunger, activating the first switching element, and wherein movement of the operating portion in a second and opposite longitudinal direction moves the second plunger engaging cam over the second plunger, activating the second switching element.

4. The switch system of claim 3 wherein the cam portion further includes a central concave section positioned between the first plunger engaging cam and the second plunger engaging cam, wherein the first and second plungers are positioned adjacent the central concave section in a neutral position of the hand operable switch, wherein neither switching element is activated.

5. The switch system of claim 4 comprising a compression spring for biasing the hand operable switch in the neutral position.

6. The switch system of claim 1 wherein the activation rod is movable rotationally about the longitudinal axis, the activation rod including a flange for engaging or disengaging with the switching element upon rotation in either direction of the operating portion about the longitudinal axis.

7. The switch system of claim 1 wherein the hand operable switch further includes a switch mount for securing the switching element within the hand operable switch, and a housing for surrounding the switching element, wherein the activation rod passes through an opening in the switch mount.

8. The switch system of claim 7 wherein the operating portion is longitudinally located between the switch mount and a handle.

9. The switch system of claim 8 further comprising an umbrella extending from the housing and surrounding the operating portion.

10. The switch system of claim 7 further comprising an O-ring positioned between the activation rod and the switch mount for sealing the switching element from debris.

11. The switch system of claim 1 comprising a first switching element and a second switching element, wherein the first switching element is activated when the operating portion is pushed in a first longitudinal direction, parallel to the longitudinal axis of the hand operable switch, and wherein the second switching element is activated when the operating portion is pushed in a second longitudinal direction, opposite the first longitudinal direction.

12. The switch system of claim 11 wherein the hand operable switch is positioned relative to a device to be controlled, wherein movement of the operating portion in the first longitudinal direction results in movement of the device in first device direction parallel to the first longitudinal direction, and movement of the operating portion in the second longitudinal direction results in movement of the device in a second device direction parallel to the second longitudinal direction and opposite the first device direction.

13. The switch system of claim 1 further comprising a converter for receiving the hand operable switch, the converter including a foot pedal for operating the hand operable switch by foot.

14. The switch system of claim 13 wherein the foot pedal includes a first pusher flange for pushing the operating portion in a first direction along the longitudinal axis when a first pedal section is depressed, wherein the switching element is a first switching element, and wherein the first switching element is activated when the first pedal section is depressed.

15. The switch system of claim 14 further comprising a second switching element, wherein the foot pedal includes a second pusher flange for pushing the operating portion in a second direction along the longitudinal axis when a second pedal section is depressed, wherein the second switching element is activated when the second pedal section is depressed.

16. The switch system of claim 1 further comprising a Hall effect sensor in the hand operable switch for sensing movement speed of the operating portion and sending a control signal for moving a controlled device at a speed relative to the movement speed of the operating portion.

17. The switch system of claim 1 further comprising a detectable element positioned for movement upon the activation rod, wherein the switching element includes one of a Hall effect sensor, potentiometer, and a light sensing element, wherein the switching element senses movement of the detectable element.

18. A converter for converting a hand operable switch, having a hand operable operating portion, into a foot operable switch, the converter comprising:

a support for removably receiving the hand operable switch; and, at least one foot pedal section, wherein the at least one foot pedal section is depressible by foot for operating the hand operable operating portion.

19. The converter of claim 18 further comprising:

a bottom plate;

a first foot pedal section and a second foot pedal section, wherein the first foot pedal section and the second foot pedal section are depressible towards the bottom plate;

a first operating portion engagement device in association with the first foot pedal section and a second operating portion engagement device in association with the second foot pedal section;

wherein depressing the first foot pedal section pushes the first operating portion engagement device against the operating portion for activating a first switching element within the hand operable switch and wherein depressing the second foot pedal section pushes the second operating portion engagement device against the operating portion for activating a second switching element within the hand operable switch.

20. The converter of claim 19 further comprising:

a first side wall for securing a first end of the hand operable switch;

a second side wall for receiving a second end of the hand operable switch; and, a foot pedal pivotally supported on the bottom floor, the first foot pedal section positioned on a first end of the foot pedal, and the second foot pedal section positioned on a second end of the foot pedal.

21. The converter of claim 20 wherein the first operating portion engagement device includes a first pusher flange extending from the foot pedal and the second operating portion engagement device includes a second pusher flange extending from the foot pedal, wherein depressing the first foot pedal section on the foot pedal pushes the first pusher flange towards a first side of the operating portion for activating the first switching element of the hand operable switch and wherein depressing the second foot pedal section on the foot pedal pushes the second pusher flange towards a second side of the operating portion for activating the second switching element of the hand operable switch.

22. The converter of claim 19 comprising a first foot pedal having the first foot pedal section on a first end of the first foot pedal, and a second foot pedal having the second foot pedal section on a first end of the second foot pedal, wherein the first operating portion engagement device includes a first button pressing section on a second end of the first foot pedal and wherein the second operating portion engagement device includes a second button pressing section on a second end of the second foot pedal, wherein the hand operable switch includes depressible buttons and is positionable within the converter with the buttons facing the bottom plate, and further wherein pressing the first foot pedal section towards the bottom plate pushes the first button pressing section towards a first button on the hand operable switch, and wherein pressing the second foot pedal section towards the bottom plate pushes the second button pressing section towards a second button on the hand operable switch.

23. The converter of claim 18 wherein the hand operable switch includes a depressible button, and wherein the at least one foot pedal section includes a first foot pedal section on a first foot pedal, the first foot pedal further including a button pressing section, wherein depressing the first foot pedal section moves the button pressing section towards the depressible button.

24. A hand operable switch comprising:

a longitudinal axis;

a housing;

a first switching element in the housing for sending a control signal to move a controlled device in a first direction;

a second switching element in the housing for sending a control signal to move a controlled device in a second direction, opposite the first direction;

an operating portion movable along the longitudinal axis, wherein movement of the operating portion towards the housing activates the first switching element and movement of the operating portion away from the housing activates the second switching element; and a handle portion extending from said operating portion, wherein said operating portion is disposed between said handle portion and said first switching element and said second switching element, and wherein said handle portion is configured to be grasped or held by a hand of a user.

25. The hand operable switch of claim 24 wherein the first switching element includes a first plunger and the second switching element includes a second plunger, wherein the second plunger is located at a different longitudinal location relative to the longitudinal axis than the first plunger, wherein the operating portion is attached to an activating rod, wherein the activating rod engages the first plunger when the operating portion is moved towards the housing and wherein the activating rod engages the second plunger when the operating portion is moved away from the housing.

* * * * *